US005344284A

United States Patent [19]

Delvaux et al.

[11] Patent Number: 5,344,284

[45] Date of Patent: Sep. 6, 1994

[54] ADJUSTABLE CLEARANCE CONTROL FOR ROTOR BLADE TIPS IN A GAS TURBINE ENGINE

[75] Inventors: John M. Delvaux, Royal Palm Beach, Fla.; William E. Roberts, Jr., Newport Beach, Calif.

[73] Assignee: The United States of America as represented by the Secretary of the Air Force, Washington, D.C.

[21] Appl. No.: 39,605

[22] Filed: Mar. 29, 1993

[51] Int. Cl.[5] ..... F01D 11/08

[52] U.S. Cl. ..... 415/173.2; 415/173.3; 415/174.1; 415/173.4

[58] Field of Search ..... 415/173.1, 173.2, 173.3, 415/173.4, 174.1, 174.2, 174.4

[56] References Cited

U.S. PATENT DOCUMENTS

| | | | |
|---|---|---|---|
| 3,836,279 | 9/1974 | Lee . | |
| 3,860,358 | 1/1975 | Cavicchi et al. . | |
| 3,966,356 | 6/1976 | Irwin . | |
| 4,135,851 | 1/1979 | Bill et al. . | |
| 4,334,822 | 6/1982 | Rossmann | 415/173.2 |
| 4,337,016 | 6/1982 | Chaplin . | |
| 4,526,509 | 7/1985 | Gay, Jr. et al. . | |
| 4,615,658 | 10/1986 | Kagohara et al. . | |
| 4,657,479 | 4/1987 | Brown et al. . | |
| 4,683,716 | 8/1987 | Wright et al. . | |
| 4,732,534 | 3/1988 | Hanser . | |
| 4,784,569 | 11/1988 | Sidenstick et al. . | |
| 4,844,688 | 7/1989 | Clough et al. | 415/173.2 |
| 5,211,534 | 5/1993 | Catlow | 415/173.2 |

FOREIGN PATENT DOCUMENTS

| | | | |
|---|---|---|---|
| 162209 | 12/1981 | Japan | 415/173.2 |
| 41407 | 3/1982 | Japan | 415/173.2 |
| 152907 | 7/1986 | Japan | 415/173.2 |
| 2103294 | 2/1983 | United Kingdom | 415/173.2 |

*Primary Examiner*—Edward K. Look
*Assistant Examiner*—James A. Larson
*Attorney, Agent, or Firm*—Donald J. Singer; Thomas C. Stover

[57] ABSTRACT

In a gas turbine engine having rotor blades which rotate with the blade tips in proximity with a surrounding rub strip in the engine shroud, an improvement is provided in the form of a radially adjustable rub strip-air bladder assembly. That is, an air bladder is mounted between the rub strip and the shroud and compressed air is fed to or withdrawn from the bladder to radially displace the rub strip so it can follow changes in the rotor blade length and maintain a close clearance with the tips of such blades under varying engine conditions, e.g. accels and decels, while minimizing contact of blade tips and rub-strip. The rub strip-bladder assembly is flexible and can react automatically to radially withdraw in advance of extending rotor blades as a pressure surge suddenly backs through such blades.

10 Claims, 4 Drawing Sheets

ADJUSTABLE CLEARANCE CONTROL FOR ROTOR BLADE TIPS IN A GAS TURBINE ENGINE

STATEMENT OF GOVERNMENT INTEREST

The invention described herein may be manufactured and used by or for the Government for governmental purposes without the payment of any royalty thereon.

BACKGROUND OF THE INVENTION

1. Field of the Invention

This invention relates to an adjustable clearance control for rotor blade tips in a gas turbine engine, particularly a control that employs a radially adjustable rub strip for said rotor blade tips.

2. The Prior Art

In conventional gas turbine engines, tip clearance of rotor blades with the housing walls changes with engine speed as well as with rotor blade and housing temperatures. Yet close blade tip clearance with the housing walls is desirable to minimize engine thrust and efficiency losses.

To deal with the problem, prior art designers have provided an abradable rub strip mounted to the engine walls in close clearance with the rotor blade tips that follow the path defined by such tips in rotation.

Taking for example, compressor blades in a gas turbine engine and referring to drawings of the prior art in FIGS. 2 and 3 hereof, gas turbine engine 10 has engine housing walls 12 and 14, compressor rotor 16, compressor blades 18, blade tips 20 and a fixed rub strip 22 as shown in FIGS. 2 and 3.

As indicated in FIG. 3, on a power surge, e.g. an "accel", the compressor blades 18 deflect and/or lengthen, biting into the fixed rub strip 22 and abrading same, as shown in FIG. 3. When the engine operates at reduced power e.g. on a decel, the compressor blades 18 retract e.g. to the dotted line indicated at 24 in FIG. 3, with a pronounced increase between clearance or gap between blade tip 20 and rub strip 22 with resulting engine efficiency and thrust losses.

Attempts have been made in the prior art to provide a rub strip concentrically mounted with rotor blades, which rub strip radially expands or contracts in response to rotor blades which expand or contract. See for examples, U.S. Pat. No. 4,683,716 to Wright (1987). Wright employs an expandable metal chamber mechanism which can be pressurized and evacuated to expand or contract the outer case wall and cause a change in the rotor tip clearance. However, this mechanism has only two positions, fully expanded and fully contracted, thus limiting engine operating conditions.

Another prior art reference is U.S. Pat. No. 4,657,479 to Brown et al. (1987). Brown employs a segmented shroud which expands and contracts circumferentially by a spring, pin and cam mechanism.

However, neither of the above references employs a variable diameter rub strip which can automatically and appropriately respond for all engine flow conditions, e.g. of engine surge or stall.

Accordingly, there is a need and market for an expandable and contractible blade tip rub strip for gas turbine engine that overcomes the above prior art shortcomings.

There has now been discovered a rub strip for rotor tip blades that is radially expandable and contractible, in keeping with the rotor blade length at various engine operating conditions, which rub strip can be programmed to respond or can automatically respond to changes in blade length at various engine operating conditions, to maintain a suitable clearance or gap with the tips of such blades.

SUMMARY OF THE INVENTION

Broadly the present invention provides in a gas turbine engine having rotor blades which rotate with their blade tips in proximity with a rub strip in the engine housing, the improvement comprising, a) providing a rub strip around the path of the rotor blades, b) backing the rub strip with an inflatable gas bladder to displace the rub strip radially relative to the blade tips and c) means for inflating and deflating the gas bladder to radially move the rub strip to follow the blade tips inwardly and outwardly to maintain a relatively close clearance or gap therewith while minimizing rubbing therebetween.

BRIEF DESCRIPTION OF THE DRAWINGS

The invention will become more apparent from the following detailed specification and drawings in which.

DESCRIPTION OF PREFERRED EMBODIMENT

Figure 1:
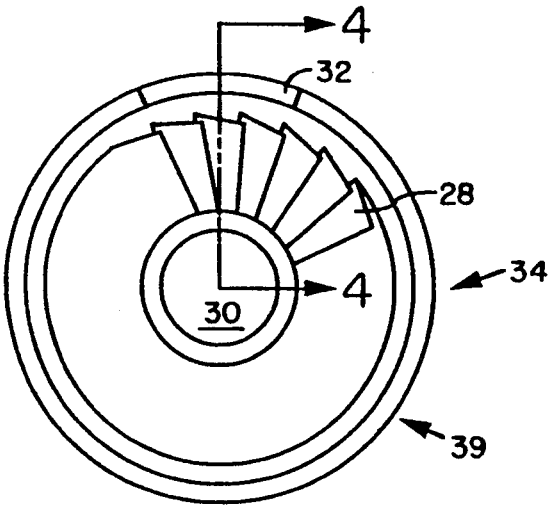
FIG. 1 is a schematic elevation view of a compressor rotor embodying the present invention.

Referring now in more detail to the drawings, compressor blades 28 are mounted around rotor 30 in close clearance with rub strip housing 32 of compressor 34 embodying the invention as shown in FIG. 1.

Figure 2:
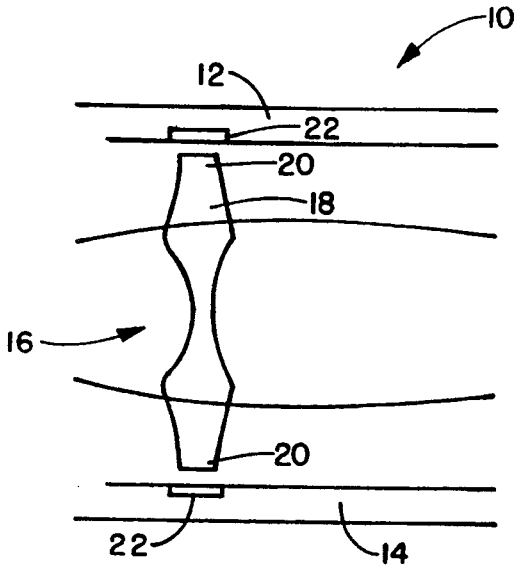
FIG. 2 PRIOR ART
FIG. 2 is a schematic sectional elevation in view of a compressor rotor of the prior art.
Figure 3:
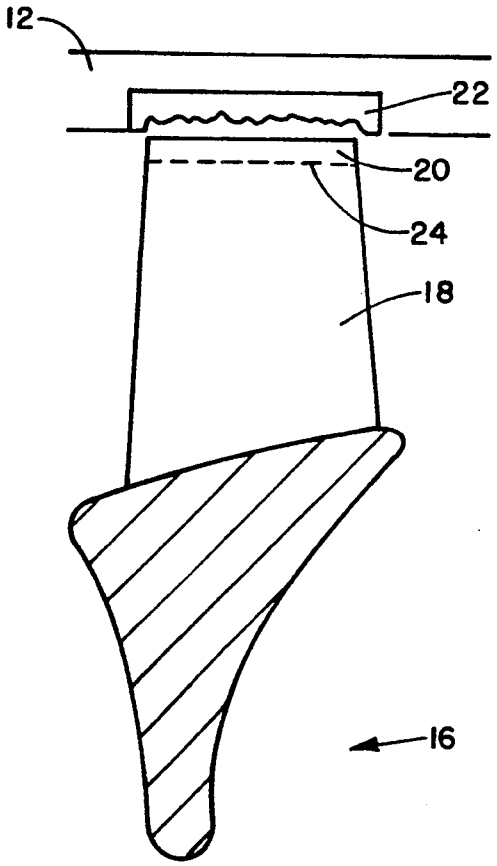
FIG. 3 PRIOR ART
FIG. 3 is an enlarged fragmentary schematic view of a compressor blade and rub strip shown in FIG. 2.

The frontal elevation view of the compressor of FIG. 1 is similar to a frontal view (not shown) of a prior art compressor rotor shown in side cross-sectional elevation in FIGS. 2 and 3 and already discussed above. However in the prior art, the rub strip 22 shown in FIG. 3, is fixed and when new is virtually flush with the engine housing or shroud wall 12, as indicated in FIG. 3.

Figure 4:
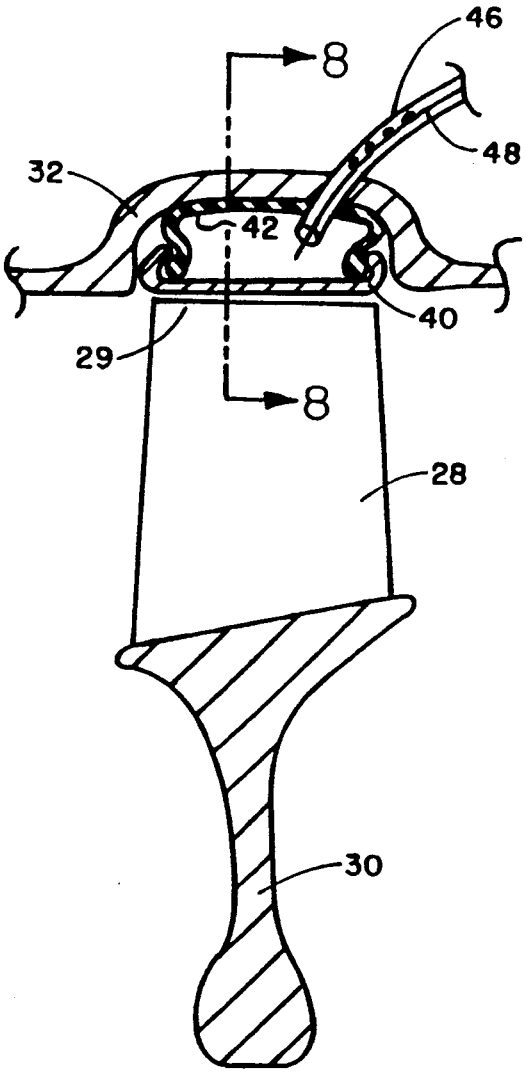
FIGS. 4 and 5 are fragmentary schematic sectional elevation views of a rotor blade and rub strip assembly according to the present invention.

However, the rub strip of the invention is not fixed and is quite different from that of the prior art and requires a different shroud wall 32, as discussed below. Thus FIG. 4 shows a cross-section of shroud wall 32 of the invention which has radially movable rub strip 40 surmounted by expandable bladder 42, as shown in FIG. 4. The rub strip assembly of rub strip 40 and bladder 42 are part of segment 36, as shown or indicated in FIGS. 7,8 and 10. The bladder 42 upon inflation or deflation thereof, can float the rub strip 40 of FIG. 4 into proper position relative to blade tip 29, as indicated in FIGS. 4 and 8 and 5 and 9.

Figure 6:
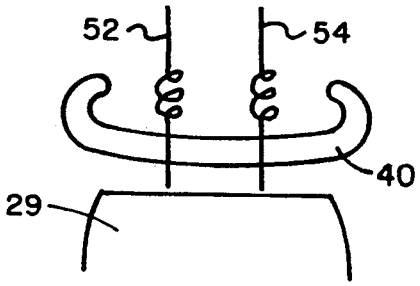
FIG. 6 is a schematic fragmentary elevation view of blade tip and rub strip members according to the present invention.
Figure 7:
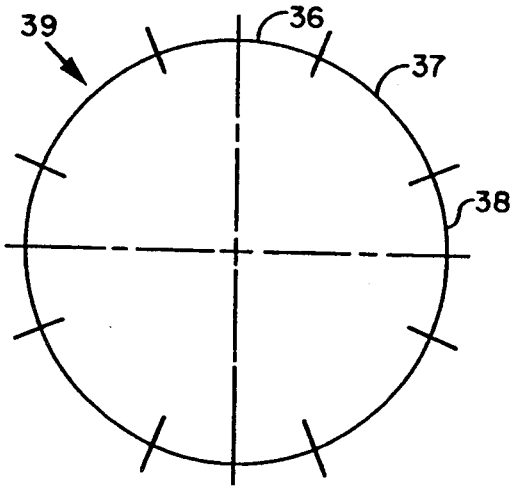
FIG. 7 is a schematic elevation view of the location of rub strip segments around a rotor shroud per the present invention.
Figure 10:
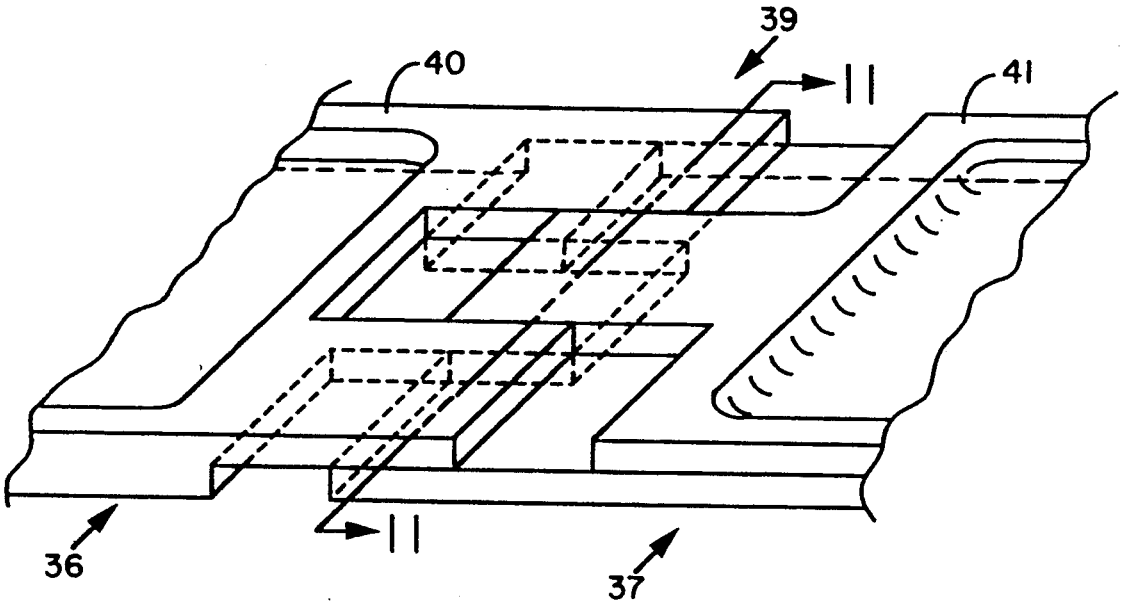
FIG. 10 is an enlarged, fragmentary, schematic perspective view of a junction of components of the rub strip assembly shown in FIGS. 8 and 9.
Figure 11:
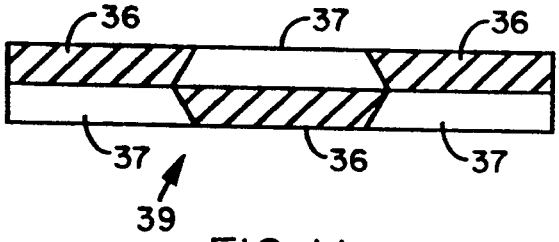
FIG. 11 is a sectional elevation view of the junction or dove-tail joint shown in FIG. 10, taken on lines 11—11, looking in the direction of the arrows

As indicated in FIGS. 1 and 7 a plurality of segments, e.g. eight 45° rub strip assembly arc segments, including segments 36, 37 and 38 can make up the enclosing rub strip assembly 39. The segments fit together in dovetail joints, providing ready assembly and operation, as indicated in FIGS. 8, 9, 10 and 11. Thus rub strip assembly segments 36 and 37 are mounted in gas turbine engine shroud wall 32 in proximity with rotor blade tips 29, as shown in FIGS. 1–9 less 7. The dovetail joint allows circumferential movement between such segments, e.g. segments 36 and 37, of joint 39, as shown in FIGS. 10 and 11. That is, segment 36 terminates in spaced fingers which interleave with complimentary fingers of adjacent segment 37 in a dovetail fit as shown in FIGS. 10 and 11. Also the radial tab 61 on engine shroud wall 32 serves to constrain the segments circumferentially, as shown or indicated in FIGS. 8 and 9. Accordingly, the eight segments can expand and contract with temperature changes within the engine, while maintaining a relatively self-supporting hoop like structure within the engine shroud wall 32, as indicated in FIGS. 7 through 11.

Each respective rub strip segment, desirably has its own bladder and rub strip segment, e.g. bladder 42 and rub strip 40 of segment 36 or bladder 43 and rub strip 41 of segment 37, per FIGS. 4,5,8 and 9. Each such segment further has compressed air feed line 46 and electrical rub strip segment displacement sensor 48, as shown in these Figures.

Thus each segment assembly has its own bladder, rub strip, compressed air feedline and position probe or sensor. Each such segment assembly can be readily interchanged with another around the loop of such segments, e.g. as shown or indicated in FIGS. 1, 7 and 10.

Thus per FIGS. 4–9, the invention provides a rub-strip bladder assembly wherein the bladder is a flexible open tube having a pair of spaced edges and the rub strip is of substantially rigid material having a pair of spaced sides and the bladder edges meet the rub strip sides in sealing engagement. In a preferred embodiment, the rub strip has a pair of bent sides to define a channel on the bladder side thereof and the edges of the bladder fit within the channel and engage the bent sides so that the backside of the rub strip caps the bladder and defines an inflatable compartment therewith. In a more preferred embodiment, the bladder edges terminate in beaded ends which fit within the bent sides of the rub strip.

Figure 8:
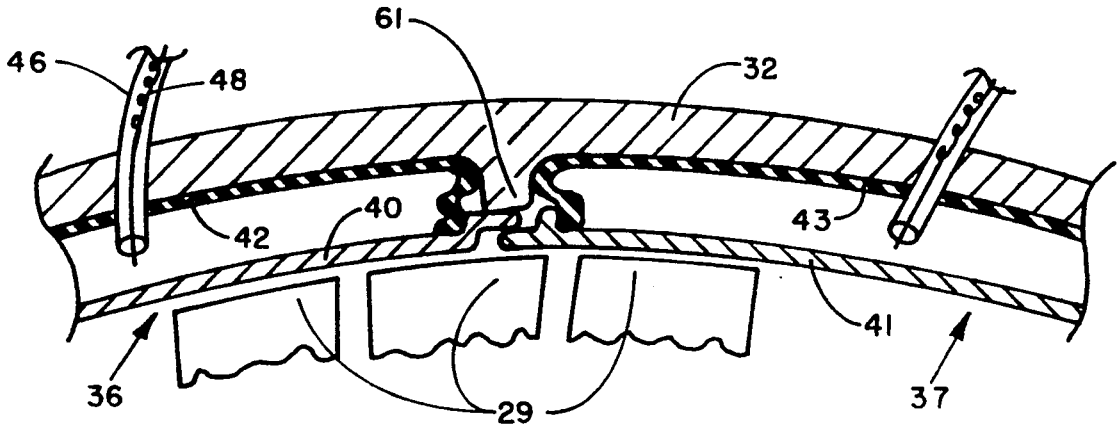
FIG. 8 is a fragmentary schematic sectional elevation view of a rotor blade and rub strip assembly, taken on lines 8—8 of FIG. 4, looking in the direction of the arrows.

In operation, with the rotor blade 28 extended under, e.g. engine accel conditions, the air is bled from the bladder 42 and the rub strip 40 is the retracted position in the rub strip housing 32, so as to maintain a minimum clearance or gap with the blade tip 29, as shown in FIGS. 4 and 8.

Figure 5:
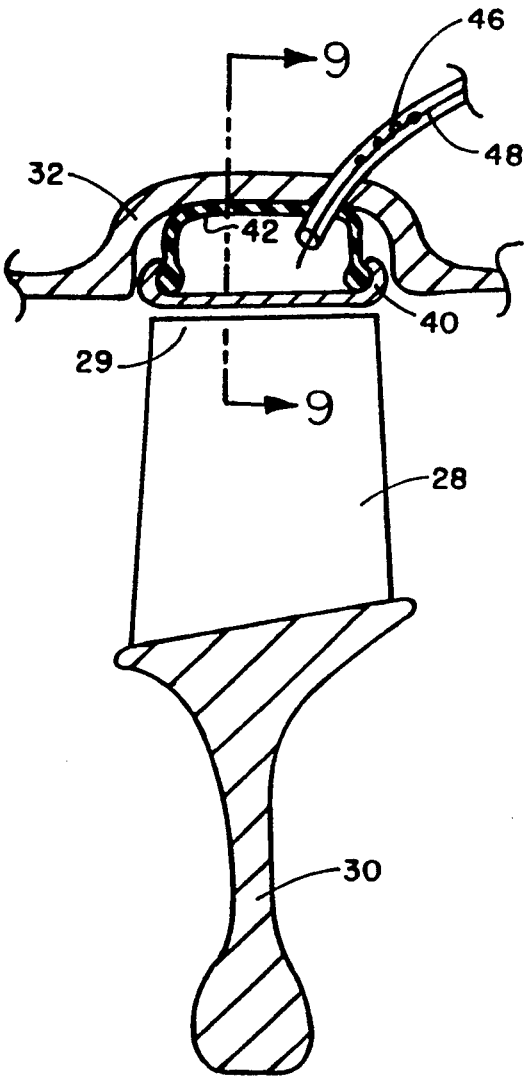
Figure 9:
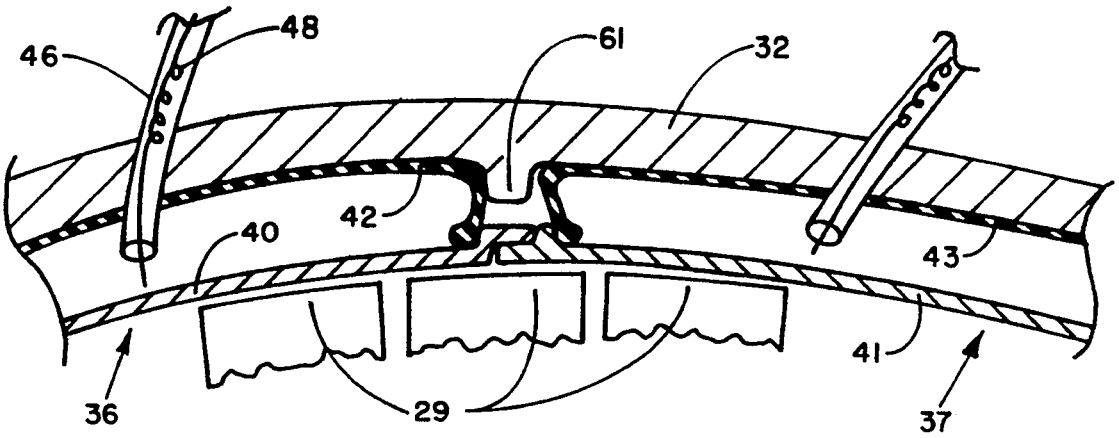
FIG. 9 is a fragmentary schematic sectional elevation view of a rotor blade and rub strip assembly, taken on lines 9—9 of FIG. 5.

Under reduced load conditions, e.g. engine decel, the rotor blade 28 retracts from its extended or deflected position and a pre-programmed computer (not shown) for such engine, feeds compressed air into the bladder 42 through compressed air feedline 46, displacing the rub strip 40 radially to follow the retracting blade tip 29 and maintain close clearance therewith, as indicated in FIGS. 5 and 9. Electrical rub strip displacement probe 48 senses when the rub strip 40 has moved sufficiently radially bladeward per the computer's preprogrammed data and reduces or closes the compressed air feed line 46, to the bladder 42, until a further change in engine operating conditions is sensed. That is, upon a subsequent accel and extension of rotor blade 28, air will be discharged from the bladder 42 through the feedline 46 retracting the rub strip 40 in advance of the extending blade tip 29, to maintain the desired clearance or gap therebetween, as indicated in FIGS. 5 and 4 hereof.

Thus compressed air is fed into the bladder 40 from a compressor (not shown) regulated by the engine electronic or computer control (not shown). The system requires a low volume of high pressure air feed through feedline 46 which displaces the rub strip 40, as indicated in FIGS. 4 and 5. The rub strip displacement electrical probe 48 monitors the radial displacement of the rub strip 40 and relays same back to the engine electronic control, which makes any necessary adjustments in the compressed air being fed to or withdrawn from the bladder 42, to maintain the desired gap between the rub strip 40 and blade tip 29, as indicated in FIGS. 4 and 5.

Until the necessary data is gathered, for rub strip displacement, which follows the advancing and retreating tip of a rotor blade, a pair of electrical sensors 52 and 54, which pass through the rub strip 40 in proximity with the blade tip 29, as shown in FIG. 6, can be employed to build up a database of, e.g. blade extension on accel and blade retraction on decel. When sufficient such data is collected, the blade tip position sensors 52 and 54 will no longer be needed and can be removed in favor of blade tip position monitoring by a preprogrammed computer or engine electronic control.

Figure 12:
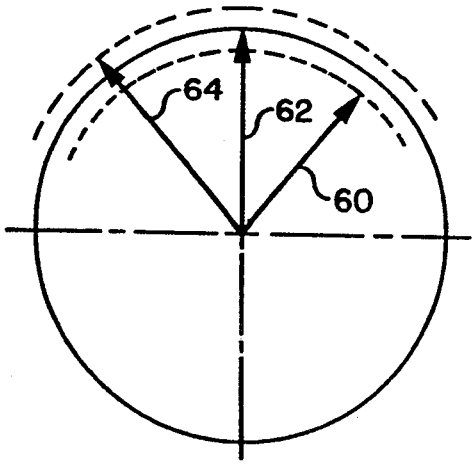
FIG. 12 is a schematic elevation view of paths traced by blade tips in rotation.

FIG. 12 shows the rub strip minimum and maximum dimensions as set by the extending and retracting blade tip positions. Thus the minimum radius is indicated by arrow 60, the median radius by arrow 62 and the maximum radius by arrow 64. The rub strip-bladder assembly of the invention is able to closely follow the rotor blade tips as they vary from max to min dimensions as indicated by FIG. 12.

The bladder operated rub strip of the invention has at least two advantages:

1) It follows the blade displacement and maintains a desired gap therebetween in varying engine operating conditions by preprogrammed computer.
2) The rub strip-bladder assembly reacts quickly and automatically to changes in internal engine pressure. That is, under a surge of back pressure against the compressor, which can last for less than 1 second, such pressure can cause the rub strip to expand against its bladder and radially retreat in advance of extending compressor blades, until the surge passes upon which the rotor blades now retreat and the rub strip radially rebounds or follows the retreating rotor blades, maintaining a desired gap therewith.

Such surges or engine pressure changes happen quickly and cannot be accounted for by preprogrammed computers.

Thus the segmented rub strips of the present invention provide near instantaneous clearance control (between rub strip and blade tips) to meet the demanding requirements of aircraft engines, particularly those which change speed and direction frequently. Thus the invention provides a variable blade tip-rub strip clearance mechanism for engine rotor blades including compressor blades. This mechanism, controlled by the engine electronic control provides:

1) maximum stall margin and
2) maximum stage efficiency by minimizing the clearance between the blade tip and the rub strip.

Accordingly, the invention provides a rub strip-bladder system that follows the radial variations of rotor blade tips, to maintain minimum clearance therebetween for high engine operating efficiencies with greatly reduced rubbing between blade tips and rub strip.

What is claimed is:

1. In a gas turbine engine having rotor blades mounted on a rotor, which blades rotate in a path with blade tips in proximity with a rub strip in an engine housing, the improvement comprising, a) said rub strip being mounted around the path of said rotor blades, b) an inflatable gas bladder mounted in said engine housing behind said rub strip, defining a rub strip-bladder assembly, to displace said rub strip radially relative to said blade tips, said bladder being a flexible open tube having a pair of spaced edges, said rub strip being of substantially rigid material having a pair of bent sides to define a channel on the bladder side thereof, said edges of said bladder fitting within said channel and engaging said bent sides so that the backside of said rub strip caps said bladder and defines an inflatable compartment therewith and c) means for inflating and deflating said gas bladder to radially move said rub strip to follow said blade tips inwardly and outwardly to maintain a relatively close clearance or gap therewith while minimizing rubbing therebetween.

2. The rub strip-bladder assembly of claim 1 having means for feeding gas to or withdrawing gas from said bladder to radially displace said rub strip relative to said blade tips.

3. The rub strip-bladder assembly of claim 2 wherein said gas is compressed air.

4. The rub strip-bladder assembly of claim 1 wherein said assembly is resilient and responsive to sudden pressure changes in said engine to expand and contract automatically therewith and radially follow said blade tips as they deflect, contract and extend on said rotor to maintain a close gap therebetween.

5. The rub strip-bladder assembly of claim 1 wherein said rotor blades are compressor blades.

6. The rub strip-bladder assembly of claim 1 wherein rub strip-bladder segments fit together end to end in a closed loop.

7. The rub strip-bladder assembly of claim 1 wherein said segments each terminate in spaced fingers which interleave with complementary fingers of an adjacent segment in a dove-tail fit.

8. The rub strip-bladder assembly of claim 1 having an electrical probe extending through said bladder to detect the radial displacement of said rub strip and relay the position thereof to an electronic control for said engine.

9. The rub strip-bladder assembly of claim 8 having a gas feed tube extending into said bladder and connected to said electronic control of said engine and means to feed or withdraw gas from said bladder and radially displace said rub strip as directed by said electronic control responsive to the sensed position of said rub strip, to follow the radial movements of said blade tips and maintain a close gap therebetween.

10. The rub strip-bladder assembly of claim 1 wherein said bladder edges terminate in beaded ends which fit within the bent sides of said rub strip.

* * * * *